US006321410B1

(12) United States Patent
Holsten

(10) Patent No.: US 6,321,410 B1
(45) Date of Patent: Nov. 27, 2001

(54) DRUM LATCH RETAINING MECHANISM FOR WET/DRY VACUUM

(75) Inventor: Stuart V. Holsten, O'Fallon, MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/387,125

(22) Filed: Aug. 31, 1999

Related U.S. Application Data

(60) Provisional application No. 60/098,395, filed on Aug. 31, 1998.

(51) Int. Cl.[7] ..... A47L 5/00
(52) U.S. Cl. ..... 15/327.2; 15/327.6; 292/101
(58) Field of Search ..... 15/327.1, 327.2, 15/327.6; 292/101

(56) References Cited

U.S. PATENT DOCUMENTS

| | | | | |
|---|---|---|---|---|
| 1,308,197 | * | 7/1919 | Schilinger | 292/101 |
| 1,702,507 | * | 2/1929 | Hennicke | 292/101 |
| 1,751,079 | * | 3/1930 | Drumm | 292/101 |
| 2,233,167 | * | 2/1941 | Holm-Hansen | 15/327.6 X |
| 2,295,984 | * | 9/1942 | Wiilson | 15/327.2 X |
| 2,722,994 | * | 11/1955 | Fisker | 15/327.6 X |
| 2,818,596 | * | 1/1958 | Martinec | 15/327.2 |
| 2,889,006 | * | 6/1959 | Ortega et al. | 15/327.6 X |
| 3,364,513 | * | 1/1968 | Brisman | 15/327.1 X |
| 4,171,208 | * | 10/1979 | Lowder | 15/327.6 X |

* cited by examiner

*Primary Examiner*—Chris K. Moore
(74) *Attorney, Agent, or Firm*—Howrey Simon Arnold & White, LLP

(57) ABSTRACT

A wet/dry vacuum appliance having a lid and a collection canister is disclosed. A latching mechanism is provided for detachably affixing the lid atop the collection canister. In one embodiment, the latching mechanism comprises a pair of opposing latch members rotatably coupled to the lid. The latching members each have an upper, end adapted to engage journals formed on the lid. Each upper end is provided with retaining means for preventing the latch member from becoming disengaged from the journals. A lower end of each latching member is adapted to engage a latching element such as a rib formed on said collection canister.

11 Claims, 12 Drawing Sheets

DRUM LATCH RETAINING MECHANISM FOR WET/DRY VACUUM

RELATED APPLICATION

This application claims the priority of prior provisional U.S. patent application Ser. No. 60/098,395 filed on Aug. 31, 1998, the content of which being hereby incorporated by reference herein in its entirety.

FIELD OF THE INVENTION

This invention relates generally to the field of vacuum cleaner appliances, and more particularly relates to a wet/dry type of vacuum cleaner.

BACKGROUND OF THE INVENTION

Vacuum cleaner appliances capable of picking up both wet and dry material, commonly referred to as wet/dry vacuums or wet/dry vacs, are well-known. Wet/dry vacs are often used in workshops and other environments where both wet and dry debris can accumulate.

Wet/dry vacs conventionally consist of a collection drum or canister, often mounted on wheels or casters, and a cover or lid upon which a motor and impeller assembly is mounted. The motor and impeller assembly creates a suction within the canister, such that debris and liquid are drawn in to the canister through an air inlet to which a flexible hose can be attached. A filter within the canister prevents incoming debris from escaping from the canister while allowing filtered air to escape. One example of a such a wet/dry vac is shown in U.S. Pat. No. 4,797,072.

Prior art examples of wet/dry vacuums include: U.S. Pat. No. 5,548,868 to Berfield et al., entitled "Pilot and Detent Apparatus for a Vacuum Device;" U.S. Pat. No. 5,535,500 to Stephens et al., entitled "Method for Manufacturing a Bucket for a Wet/Dry Vacuum;" U.S. Pat. No. 5,598,605 to Tomasiak, entitled "Wet/Dry Utility Vacuum with a Wheel Mount;" U.S. Pat. No. 5,555,600 to Corson, entitled "Non-Tipping Wet/Dry Vacuum;" U.S. Pat. No. 5,606,769 to Tomasiak, entitled "Wet/Dry Utility Vacuum Cleaner with Detachable Blower;" U.S. Pat. No. 5,608,945 to Crouser, et al., entitled "Wet/Dry Utility Vacuum Cleaner;" and U.S. Pat. No. 5,611,107 to Tomasiak et al., entitled "Latching Mechanism for Wet/Dry Utility Vacuum Cleaner with Detachable Blower."

In many wet/dry vac designs, the motor and impeller assembly is mounted on the cover or lid of the collection canister. That is, in many designs, the collection canister's lid carries and/or is integrally formed with the motor and impeller assembly. To facilitate the emptying of debris from the collection canister, the lid is preferably detachably affixed onto the collection canister. To this end, a latching mechanism of some sort is preferably provided for enabling a user to detach the lid from the canister.

SUMMARY OF THE INVENTION

The present invention is directed to a wet/dry vacuum appliance having a drum latching mechanism for detachably securing the lid atop the collection canister. In one embodiment, the latching mechanism comprises a pair of opposing latch members rotatably coupled to the lid generally at the perimeter thereof and adapted to engage retaining ribs formed at corresponding locations on the perimeter of the canister. In accordance with one aspect of the invention, the configuration of the rotatable coupling of the latch members to the lid is such that once the latch members are mounted onto the lid, they are prevented from being inadvertently removed from the lid.

BRIEF DESCRIPTION OF THE DRAWINGS

Various features and aspects of the present invention will perhaps be best appreciated with reference to detailed descriptions of specific embodiments of the invention, when read in conjunction with the accompanying drawings, wherein.

DETAILED DESCRIPTION OF A SPECIFIC EMBODIMENT OF THE INVENTION

Figure 1:
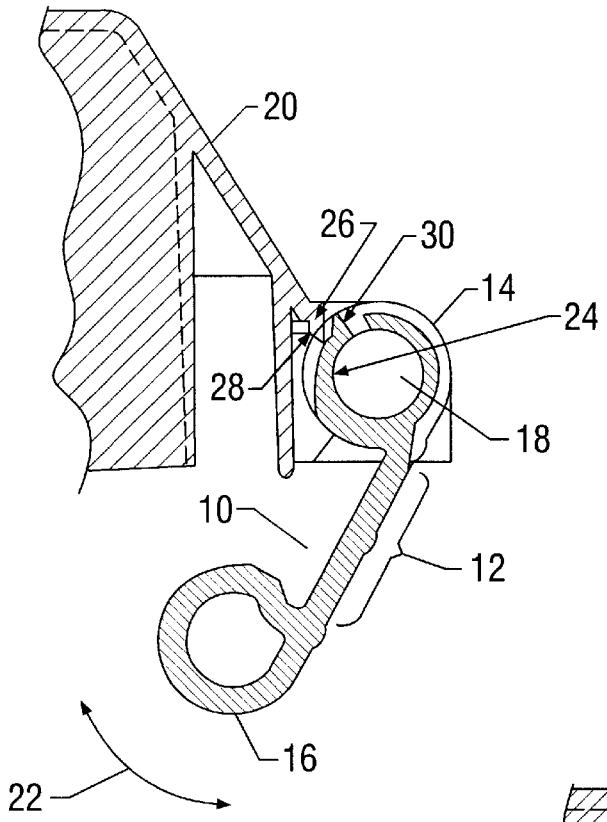
FIG. 1 is a side, cross-sectional view of a latch member accordance with one embodiment of the invention, with the latch member being shown as it is in the process of being mounted onto a collection canister lid, shown partially cut-away in FIG. 1.

FIG. 1 is a side, cross-sectional view of a latch member 10 in accordance with one embodiment of the invention. As can be seen in FIG. 1, latch member 10 (hereinafter referred to merely as "latch 10" for brevity) comprises a central "face" element 12, and upper and lower elements 14 and 16, respectively. Although central element 12 in the presently disclosed embodiment is substantially planar, it is contemplated that in alternate embodiments central element 12 may have some amount of curvature. Likewise, although end elements 14 and 16 are substantially cylindrical in the disclosed embodiment, those of ordinary skill in the art having the benefit of the present disclosure will recognize that other configurations of upper and lower elements may be possible.

As shown in FIG. 1, latch 10 is adapted to engage one or more flattened journals 18 formed on lid 20, such that latch 10 is rotatable with respect to lid 20 as indicated by arrow 22 in FIG. 1.

FIG. 1 shows latch 10 in the process of being mounted onto lid 20. As will hereinafter become more apparent, the flattened face of journal 18 allows upper end 14 of latch 10 to slide over and engage journal 18. This constitutes one-time attachment of latch 10 to lid 20, a process that would preferably be undertaken as part of the manufacturing process. In particular, once latch 10 is attached to lid 20, it is desirable to prevent latch 10 from subsequently becoming detached from lid 20. To this end, upper end 14 is provided with retaining means for preventing upper end 14 from disengaging journal 18 once it has been installed.

Figure 16:
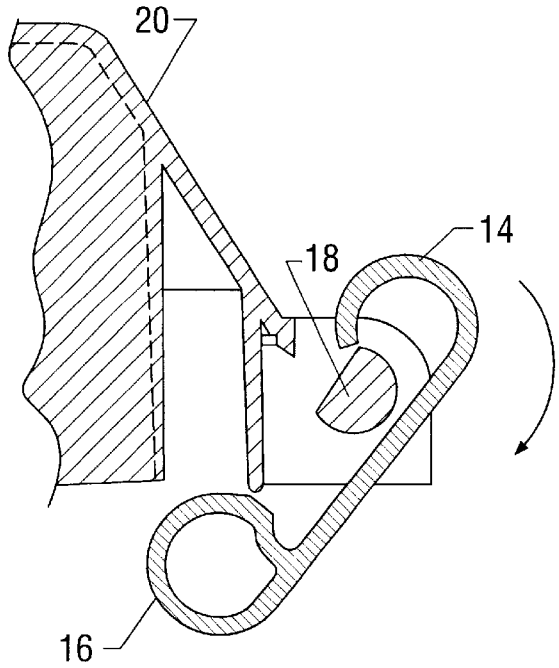
Figure 17:
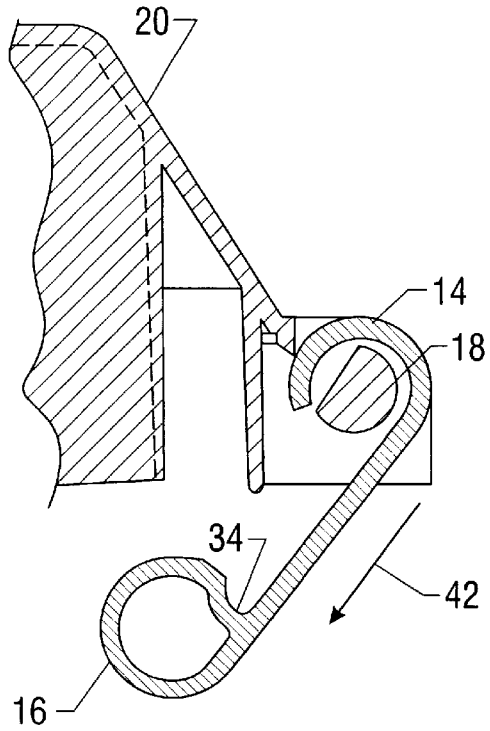
Figure 18:
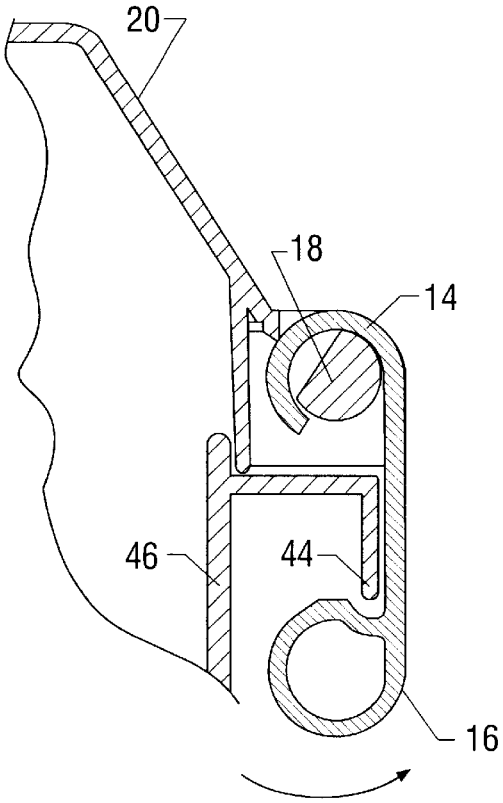

FIGS. 16 through 18 illustrate how the flattened face of journal 18 allows latch 10 to slide onto and engage journal 18. Those of ordinary skill in the art will appreciate that with this arrangement, latch 10 must be in the proper angle with respect to journal 18 before it can slide over journal 18 and engage it. Once journal 18 is engaged, latch 10 is rotated such that bottom end 16 is raised upwardly respect to lid 20. As latch 10 is so rotated, a retaining spring designated with reference numeral 24 in the Figures engages a retaining rib 26 formed in lid 20 in proximity to journal 18. Spring 24 flexes over retaining rib 26 and then springs back after passing over rib 26. A lead in taper designated with reference numeral 25 (see, e.g., FIG. 8) enhances the flexing of spring 24. Thereafter, if latch 10 is attempted to be rotated back toward the position shown in FIGS. 1 and 17, a stop-face 30 of spring 24 butts up against a stop-face 28 of retaining rib 26, preventing latch 10 from disengaging journal 18.

Figure 2:
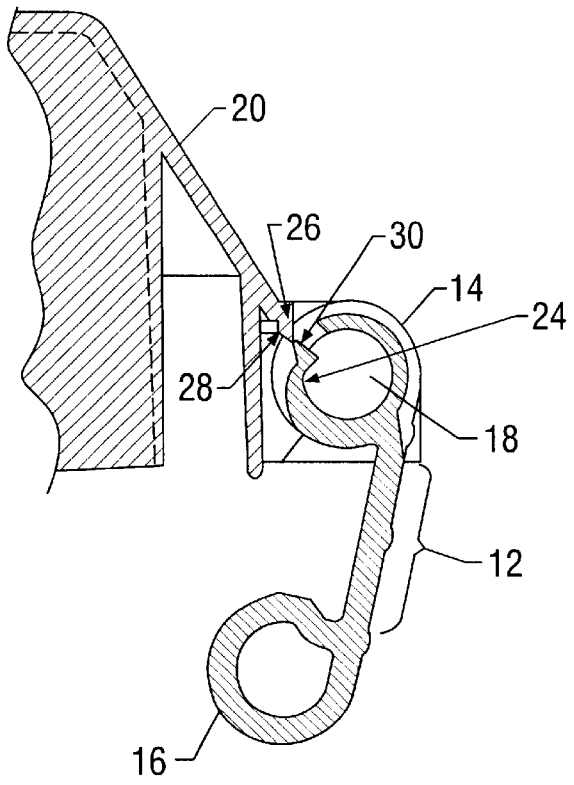
FIG. 2 is a side, cross-sectional view of the latch member from FIG. 1, shown in FIG. 2 as a flexible spring member thereof is flexing over a retaining rib formed in the lid during mounting of the latch member onto the lid.

FIG. 2 is a side, cross-sectional view of the latch 10 from FIG. 1, shown in FIG. 2 as spring member 24 is flexing over retaining rib 26 during mounting of the latch 10 onto lid 20.

Figure 3:
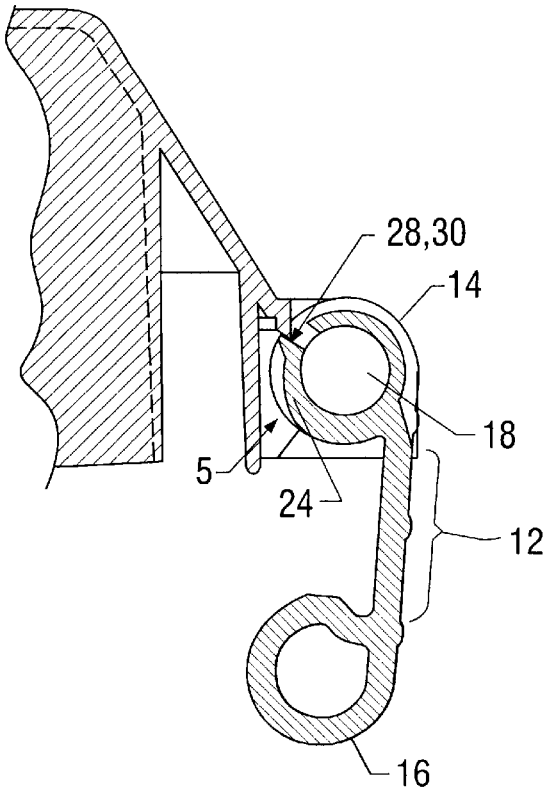
FIG. 3 is a side, cross-sectional view of the latch member from FIG. 1, shown in FIG. 3 being fully mounted onto the lid such that a retaining rib formed on the lid prevents the latch member from being un-mounted from the lid.
Figure 4:
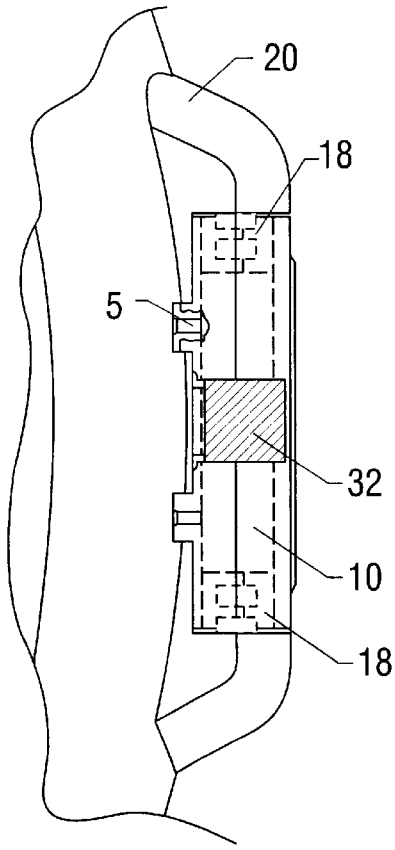
FIG. 4 is a top view of the latch member from FIG. 1 after mounting on the lid, shown partially cut-away in FIG. 4.
Figure 5:
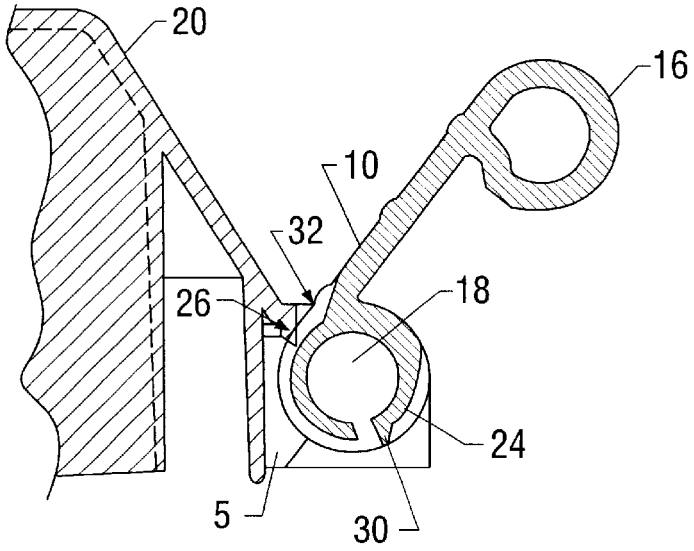
FIG. 5 is a side, cross-sectional view, corresponding to the section designated A—A in FIG. 4, of the latch member from FIG. 1, showing a clearance recess formed in the latch member to accommodate the retaining rib formed on the lid.

FIG. 3 is a side, cross-sectional view of latch 10 from FIG. 1, shown in FIG. 3 being fully mounted onto the lid such that retaining rib 26 prevents the latch member 11 from being un-mounted from lid 20;

FIG. 4 is a top view of the latch member from FIG. 1 after mounting on the lid. FIG. 5 is a side, cross-sectional view, corresponding to the section designated A—A in FIG. 4. A shaded area in FIGS. 4 and 5 corresponds to a clearance recess 32 formed in latch 10 to accommodate retaining rib 26.

Figure 6:
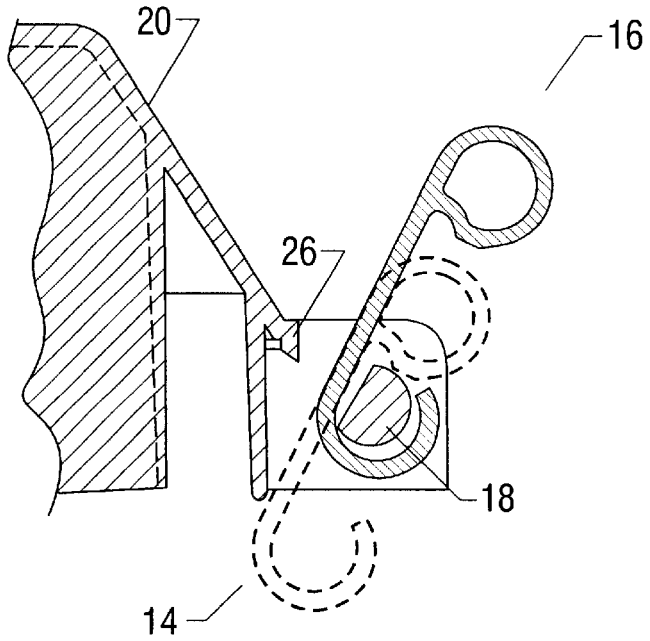
FIG. 6 is a side, cross-sectional view, corresponding to the section designated B—B in FIG. 4, of the latch member from FIG. 1.

As previously discussed, FIG. 6 is a side, cross-sectional view, corresponding to the section designated B—B in FIG. 4, of latch 10.

Figure 7:
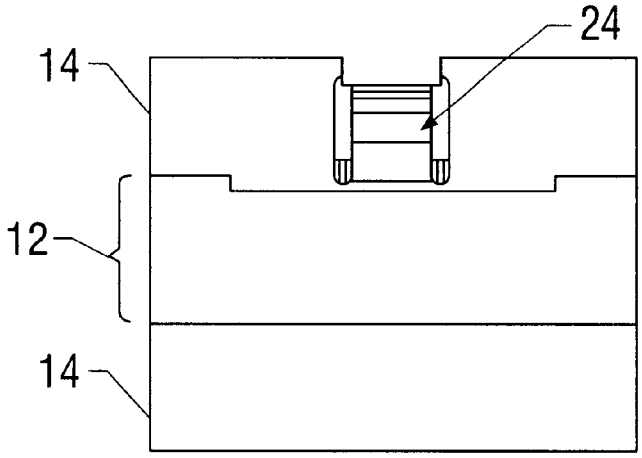
FIG. 7 is a back view of the latch member from FIG. 1, with the positions of sections designated A—A, B—B, and C—C being shown.
Figure 8:
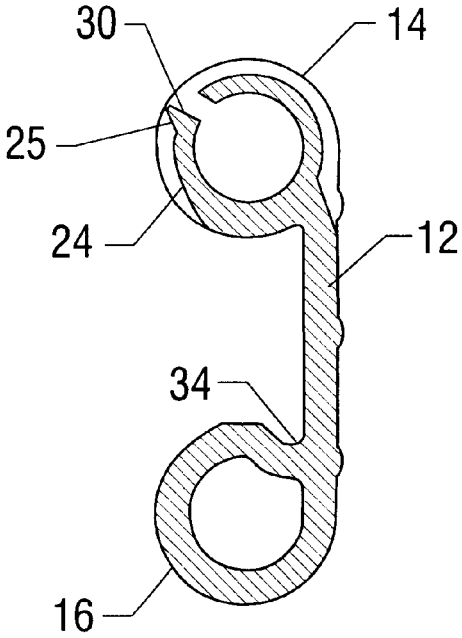
FIG. 8 is a side, cross-sectional view of the latch member from FIG. 1, corresponding to the section designated A—A in FIG. 7.

FIG. 7 is a back view of the latch member from FIG. 1, with the positions of sections designated A—A, B—B, and C—C being shown. FIG. 8 is a side, cross-sectional view of latch 10, corresponding to the section designated A—A in FIG. 7. Note from FIG. 8 that bottom end element 16 of latch 10 has a notch 34 formed at the base thereof, adapted to engage a latching rib formed on canister 46 in a "snap-fit" manner.

Figure 9:
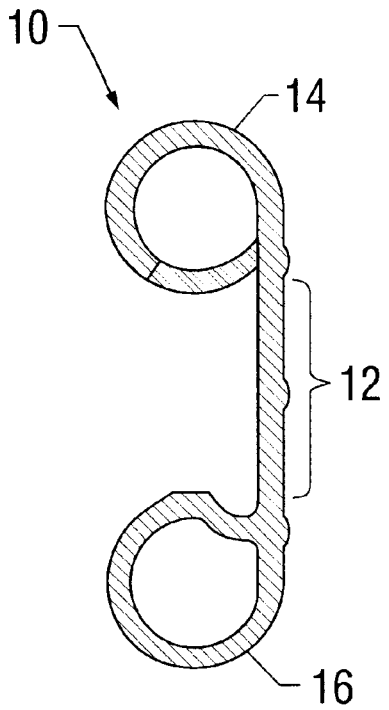
FIG. 9 is a side, cross-sectional view of the latch member from FIG. 1, corresponding to the section designated B—B in FIG. 7.
Figure 10:
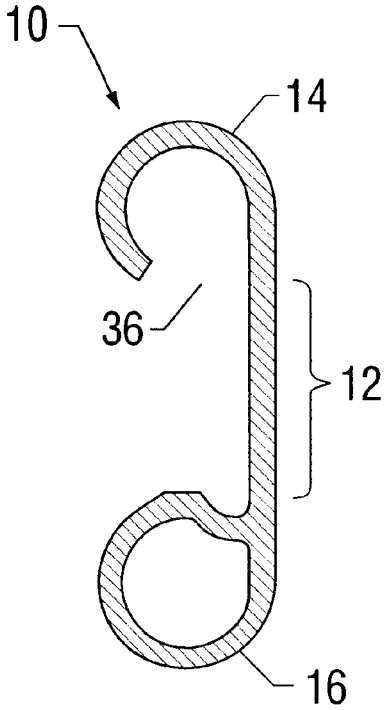
FIG. 10 is a side, cross-sectional view of the latch member from FIG. 1, corresponding to the section designated C—C in FIG. 7.

FIG. 9 is a side, cross-sectional view of latch 10, corresponding to the section designated B—B in FIG. 7, and FIG. 10 is a side, cross-sectional view of latch 10, corresponding to the section designated C—C in FIG. 7. Comparing FIG. 9 and FIG. 10, cut-outs 36 on each side of upper end element 14 are apparent. As would be appreciated by those of ordinary skill in the art, these cut-outs 36 allow latch 10 to engage journals 18 when latch 10 is inserted at the lead-in angle depicted in FIG. 14. Cut-outs 36 are also apparent in FIG. 12.

Figure 11:
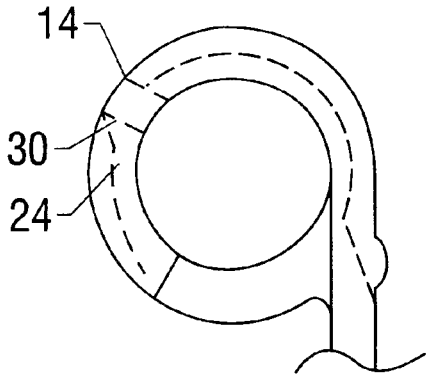
FIG. 11 is an enlarged, partial side, view of an end portion of the latch member from FIG. 1 adapted to engage journals formed on the canister lid.
Figure 12:
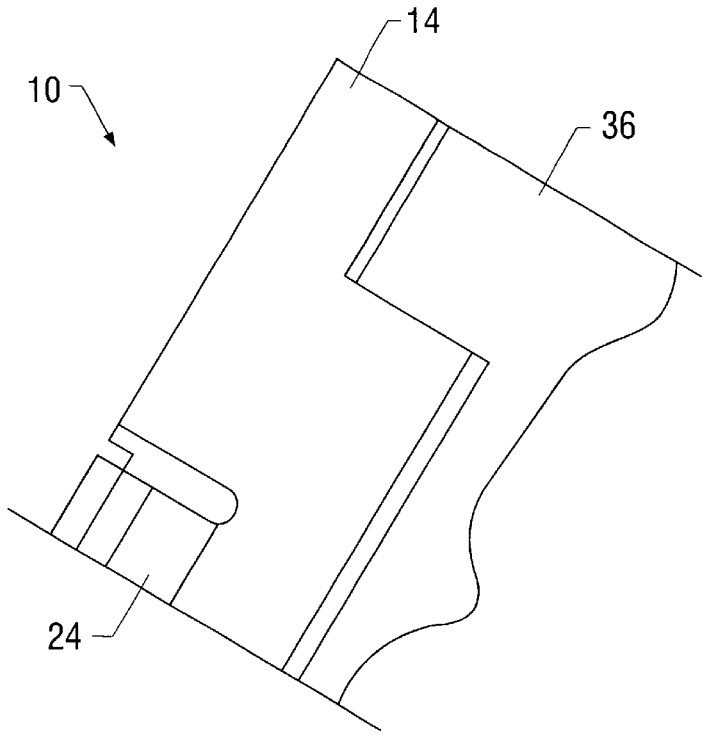
FIG. 12 is a perspective view, corresponding to the section designated F—F in FIG. 11, of an end portion of the latch from FIG. 1.

FIG. 11 is an enlarged, partial side, view of an end portion of latch 10. FIG. 12 is a perspective view, corresponding to the section designated F—F in FIG. 11, of cylindrical end portion 14 of latch 10.

Figure 13:
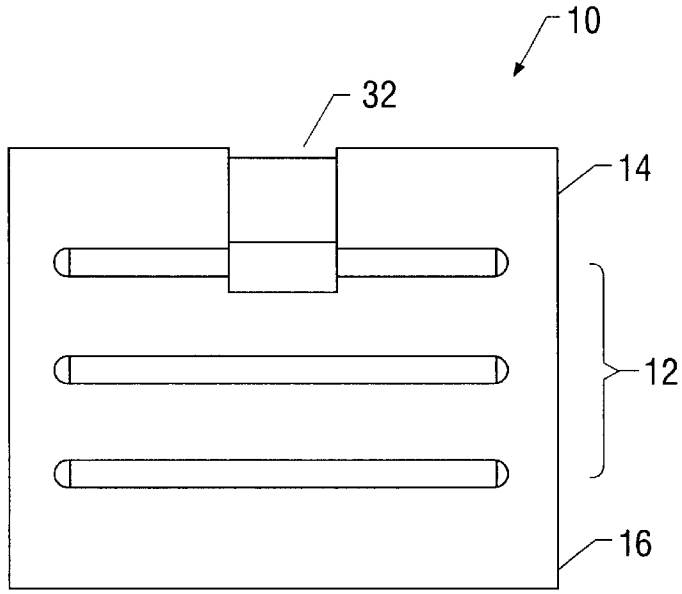
FIG. 13 is a front view of the latch from FIG. 1.

FIG. 13 is a front view of the latch from FIG. 1. Clearance recess 32 is apparent from FIG. 13.

FIGS. 14, 15, 16, 17, and 18 are a sequence of side, cross-sectional views illustrating the process of installation of latch 10 onto lid 20. For clarity, details of spring mechanism 24, retaining rib 26 and so forth are not depicted in FIGS. 14–18. Indeed, it is contemplated that in one embodiment of the invention, the spring retaining mechanism is not required, although this has the potential disadvantage of allowing latch 10 to become inadvertently detached from lid 20.

Figure 14:
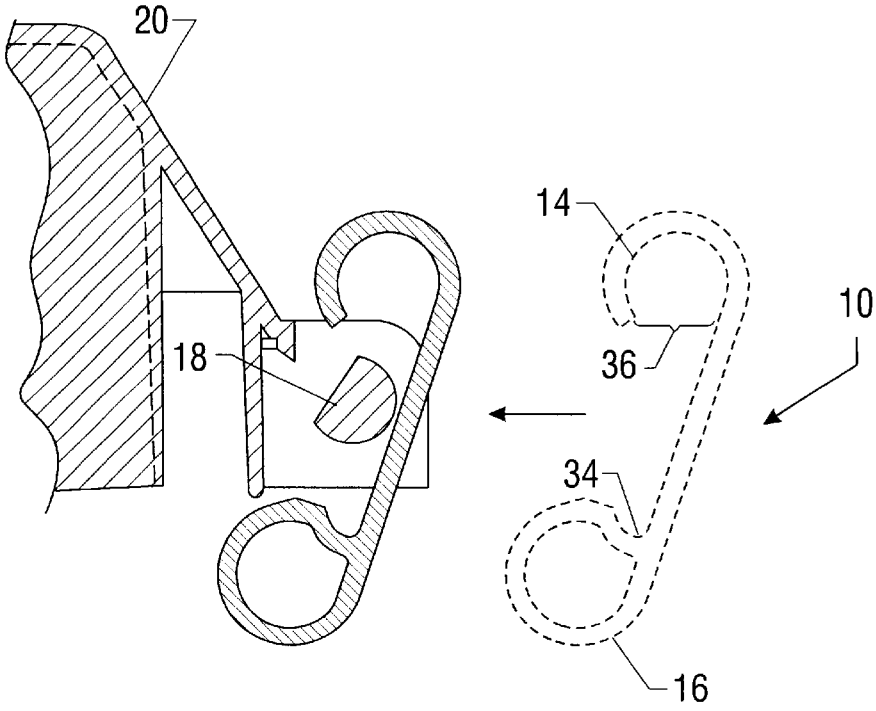
FIGS. 14, 15, 16, 17, and 18 are a sequence of side, cross-sectional views illustrating the process of installation of the latch from FIG. 1 onto the lid of a wet/dry vacuum.
Figure 15:
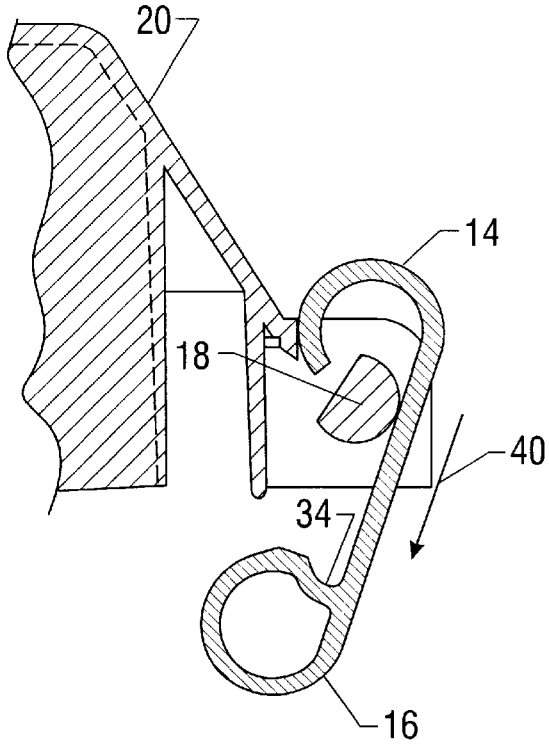

First, as illustrated in FIG. 14, latch 10 is positioned over journal(s) 18. This process requires lid 20 to be off of the canister (not shown). Next, as represented by arrow 40 in FIG. 15, latch 10 is drawn down such that journals 18 enters into upper cylindrical element 14 through cut-outs 36.

As previously noted, FIG. 16 shows latch 10 positioned in the "lead-in" angle at which it must be in order for flattened journals 18 to be able to pass through cut-outs 36. Notably, positioning latch 10 in the lead-in angle of FIG. 16 requires lid 20 to be off of the canister (not shown); thus, even without spring mechanism 24 for preventing inadvertent removal of latch 10, latch 10 cannot physically be removed from journals 18 when lid 20 is installed onto a canister.

Finally, as shown in FIG. 17, latch 10 is then drawn further downward, as represented by arrow 42, until journals 18 are fully engaged within cylindrical element 14.

FIG. 18 is a cross-sectional view showing latch 10 engaging a latching rib 44 formed in a canister 46.

Figure 19:
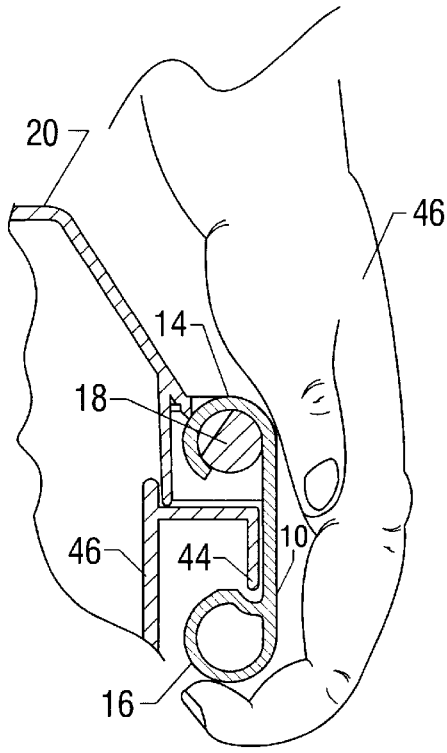
FIGS. 19, 20, and 21 are a sequence of side views illustrating the process of unlatching the latch from FIG. 1 from the canister of a wet/dry vacuum.
Figure 20:
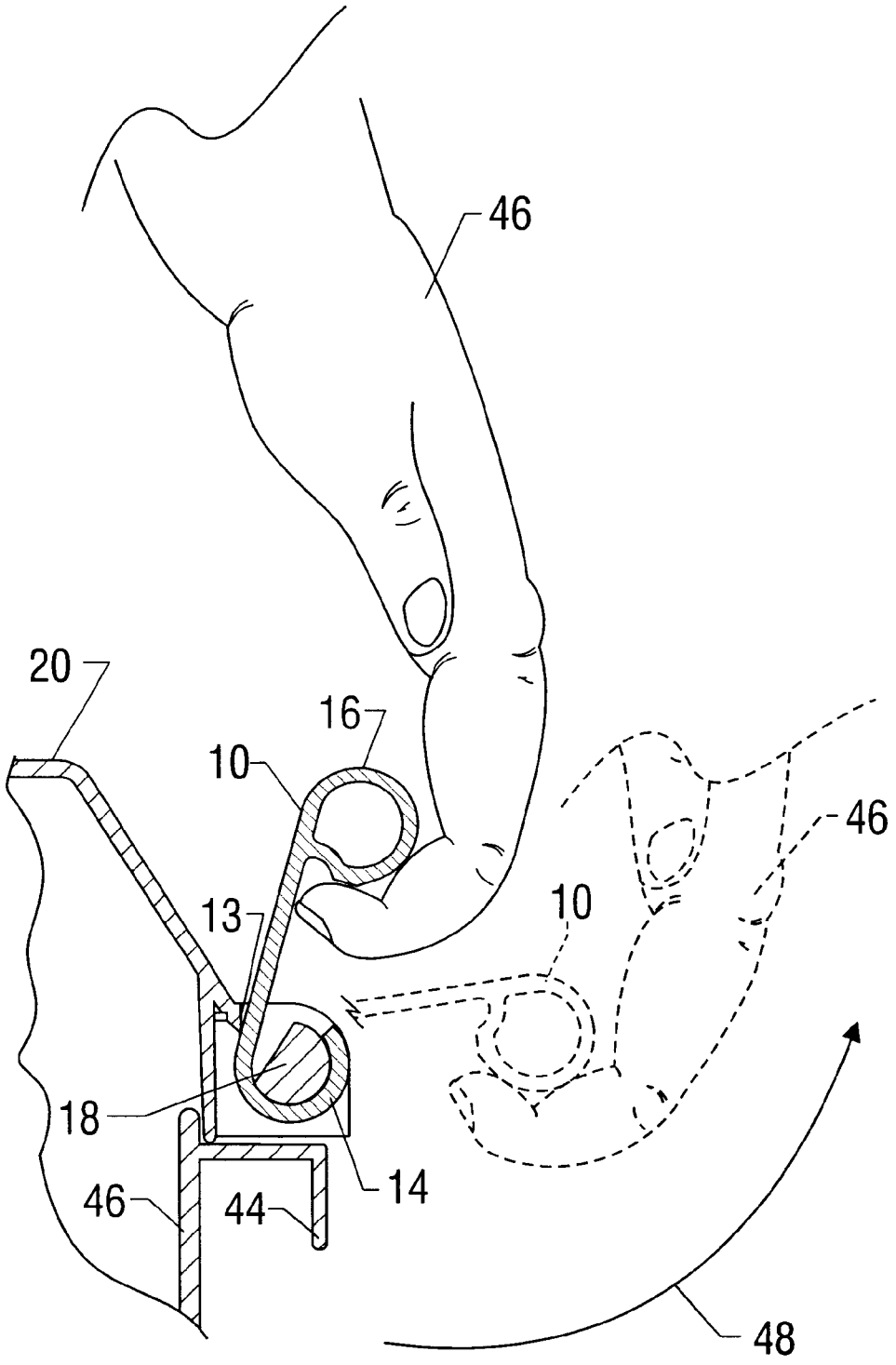
Figure 21:
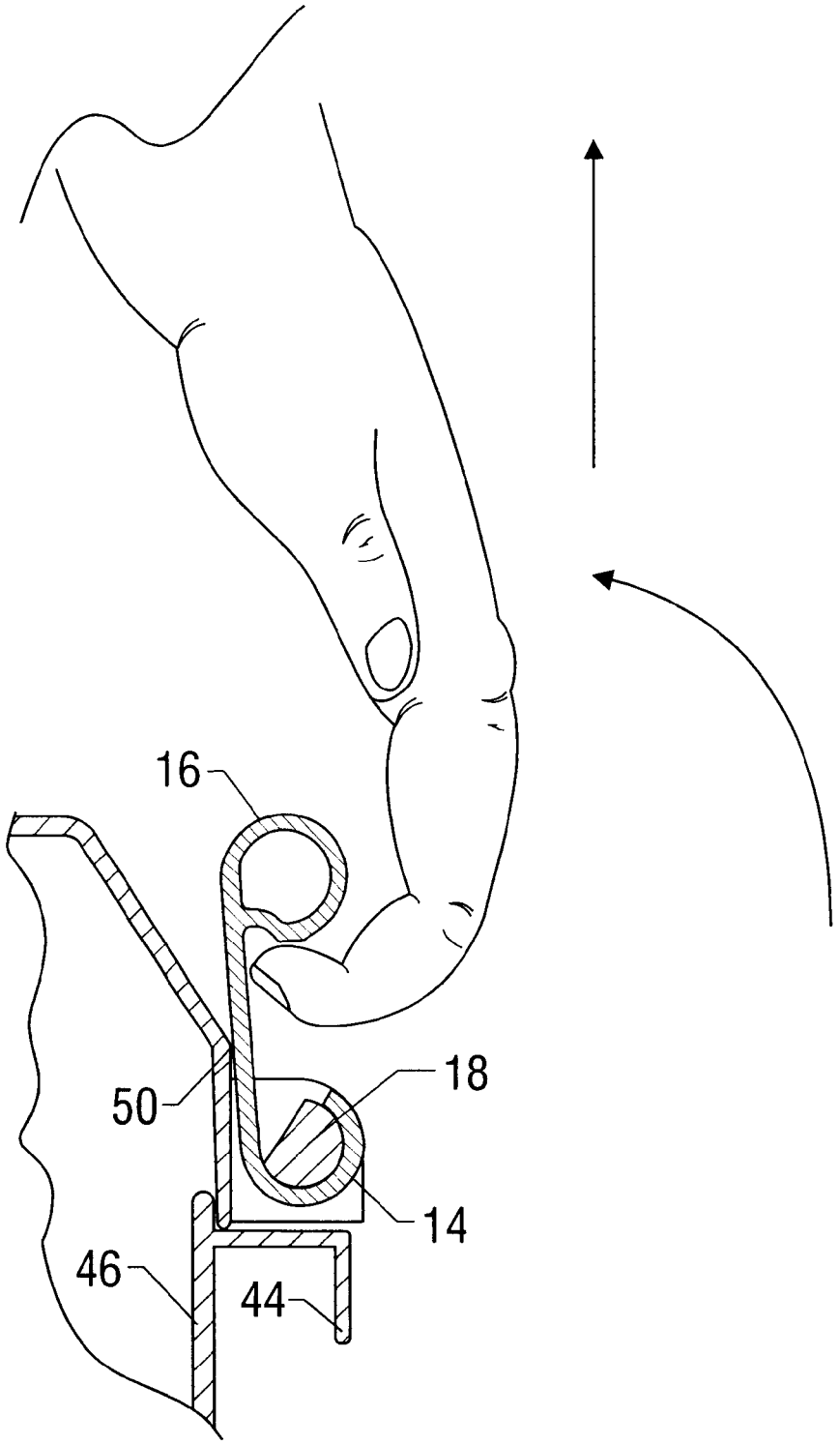

FIGS. 19, 20, and 21 are a sequence of side views illustrating the process of unlatching latch 10 from canister 46. The first step is for the operator to grasp latch 10 with his or her hand 47, with the fingers of hand 47 disposed generally beneath lower cylindrical element 16 of latch 10. Notably, in one embodiment of the invention, latch 10 is wide enough to accommodate all four fingers of hand 46, maximizing the operator's leverage in unlatching latch 10.

Next, as shown in FIG. 20, the operator draws latch 10 back away from canister 46, as represented by arrow 48 in FIG. 20. As this occurs, the operator's fingers are allowed to gradually engage lower cylindrical element 16 as it rotates to a position increasingly above upper cylindrical element 14. Eventually, as shown in FIG. 21, latch 10 will rotate about journals 18 until central portion 12 comes into contact with a side portion 50 of lid 20. At this point, then, latch 10 serves the additional function of a handle, as the operator may grasp lower cylindrical element 16 and raise lid 20 up away from canister 46.

In the presently preferred embodiment of the invention, latch member 10 is made of molded polypropylene, although it is contemplated that other materials may be suitable for the purposes of the present invention.

Figure 22:
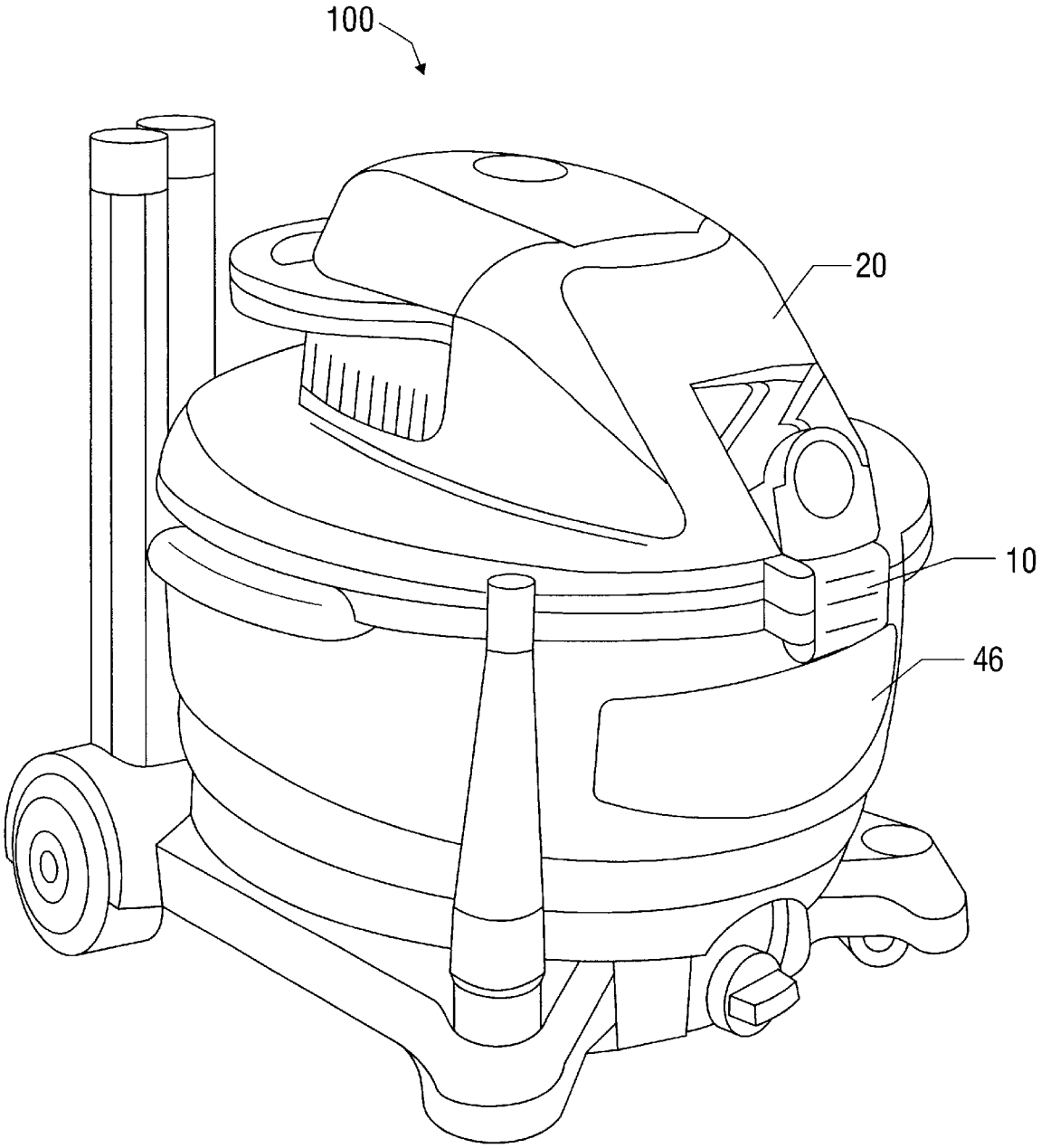
FIG. 22 is a perspective view of a wet/dry vacuum utilizing the latch from FIG. 1.

FIG. 22 is a perspective view of a wet/dry vacuum appliance 100 utilizing latches 10 in accordance with the disclosed embodiment. As shown in FIG. 22, wet/dry vac 100 comprises a canister 46 having a lid 20 disposed thereon.

From the foregoing detailed description of a specific embodiment of the invention, it should be apparent that a drum latching mechanism for detachably securing a lid to a collection drum has been disclosed. Although a specific embodiment of the invention has been described herein in detail, this has been done solely for the purposes of illustrating various aspects of the invention, and is not intended to be limiting with respect to the scope of the invention. It is contemplated that various substitutions, alternations, and/or modifications, including but not limited to those design variations which may have been specifically mentioned herein, may be made to the disclosed embodiment without departing from the spirit and scope of the invention, as defined in the claims associated with this disclosure.

What is claimed is:

1. A latching mechenism or securing a wet/dry vacuum lid to a collection canister, comprising:

a latch member comprising a face element extending between two opposing, end elements;

wherein a first of said end elements is adapted to rotatably engage at least one journal formed on said lid;

and wherein a second of said end elements is adapted with a retainer to engage a latching element formed on said collection canister.

2. A latching mechanism in accordance with claim 1, wherein , said first of said end elements has formed therein retaining means for preventing said latch member from disengaging said at least one journal after rotatably engaging said at least one journal.

3. A latching mechanism in accordance with claim 2, wherein said at least one journal is flattened to permit initial engagement by said first end element when said latch member is in a predetermined lead-in position with respect to said at least one journal.

4. A latching mechanism in accordance with claim 3, wherein said retaining means comprises a spring element formed in said first end element.

5. A latching mechanism in accordance with claim 4, further comprising a rib on said lid, said rib cooperating with said spring element after said first end element engages said at least one journal to prevent rotation of said latch member into said lead-in position with respect to said at least one journal.

6. A latching mechanism in accordance with claim 1, wherein said latching element is a rib formed integrally with said collection canister.

7. A latching mechanism in accordance with claim 1, wherein after engagement of said first end element with said at least one journal, said latch member is rotatable from a first position in which said second end element engages said latching element on said canister, to a second position in which said second element is adapted to be grasped by an operator's hand for removal of said lid from said collection canister.

8. A method of preventing detachment of a latch member having an end element rotatably engaging at least one journal disposed on a vacuum appliance lid, wherein said end element is adapted to initially engage said at least one journal only when said latch member is at a predetermined lead-in position with respect to said at least one journal, comprising:

(a) forming a spring element in said first end element;

(b) forming a retaining rib on said lid;

such that alter initial engagement of said end element with said at least one journal, said latch member is drawn in a direction to allow full engagement of said end element with said at least one journal, and said spring element and said retaining rib cooperate to prevent subsequent rotation of said latch member into said lead-in position.

9. A wet/dry vacuum appliance, comprising:

a collection canister having an open top;

a lid adapted to cover said open top of said collection canister;

a latching mechanism for securing said lid to said collection canister, wherein said latching mechanism comprises a latch member comprising a face element extending between two opposing, end elements;

wherein a first of said end elements is adapted to rotatably engage at least one journal formed on said lid;

wherein a second of said end elements is adapted with a retainer to engage a latching element formed on said collection canister.

10. A latching mechanism for securing a wet/dry vacuum lid to a collection canister, comprising:

a latch member comprising a face element extending between two opposing, end elements;

wherein a first of said end elements is adapted to rotatably engage at least one journal formed on said lid;

wherein a second of said end elements is adapted with a retainer to engage a latching element formed on said collection canister;

and wherein said first of said end elements has formed therein retaining means for preventing said latch member from disengaging said at least one journal after rotatably engaging said at least one journal.

11. A latching mechanism for securing a wet/dry vacuum lid to a collection canister, comprising:

a latch member comprising a face element extending between two opposing, end elements;

wherein a first of said end elements is adapted to rotatably engage at least one journal formed on said lid;

and wherein a second of said end elements contains a notch to engage a latching element formed on said collection canister.

* * * * *

UNITED STATES PATENT AND TRADEMARK OFFICE

CERTIFICATE OF CORRECTION

PATENT NO. : 6,321,410 B1
DATED : November 27, 2001
INVENTOR(S) : Stuart V. Holsten It is certified that error appears in the above-identified patent and that said Letters Patent is hereby corrected as shown below:

Column 5,
Line 20, delete the word "or" and insert -- for --
Line 30, delete the "," after the word "wherein."

Signed and Sealed this

Twenty-first Day of May, 2002

*Attest:*

*Attesting Officer*

JAMES E. ROGAN
*Director of the United States Patent and Trademark Office*